US005265663A

United States Patent [19]

Munekata et al.

[11] Patent Number: 5,265,663

[45] Date of Patent: Nov. 30, 1993

[54] ARCHITECTURAL SHUTTER CURTAIN DEVICE

[75] Inventors: Masaaki Munekata; Noriaki Tokuyama, both of Tokyo, Japan

[73] Assignee: Sanwa Shutter Corporation, Tokyo, Japan

[21] Appl. No.: 787,894

[22] Filed: Nov. 5, 1991

[30] Foreign Application Priority Data

Feb. 14, 1991 [JP] Japan ..... 3-5914[U]
Mar. 27, 1991 [JP] Japan ..... 3-18816[U]

[51] Int. Cl.[5] ..... E06B 9/08
[52] U.S. Cl. ..... 160/133; 160/235
[58] Field of Search ..... 160/133, 236, 229.1, 160/235

[56] References Cited

U.S. PATENT DOCUMENTS 3,698,346 10/1972 Bauer ..... 160/133 X
4,380,260 4/1983 Labelle ..... 160/235
4,519,434 5/1985 Forquer ..... 160/133
4,524,814 6/1985 Deziel ..... 160/133
4,633,927 1/1987 Labelle ..... 160/133
5,163,493 11/1992 Kraeutler ..... 160/236 X

FOREIGN PATENT DOCUMENTS 425012 3/1935 United Kingdom ..... 160/133

*Primary Examiner*—Blair M. Johnson
*Attorney, Agent, or Firm*—Oliff & Berridge

[57] ABSTRACT

An architectural shutter curtain device having a train of a plurality of slats connected in series and adapted to be wound to form a plurality of turns on a take-up shaft of a polygonal shape having n apices. The width of the slats is varied in accordance with the change in the diameter of the wound shutter curtain device. In a group of n pieces of slats which form any one of the turns of the polygon formed when the shutter curtain device S is wound, the first to (n−2)-th slats and the n-th slat $P_n$ as counted from the winding start end have an equal width corresponding to the length of one side of the polygonal form, while the (n−1)-th slat of the group has the same width as the first to (n−2)-th slats of the group of n pieces of slats which form the next turn of a polygonal form of an increased size. The take-up shaft for winding the shutter curtain device thereon is so constructed that the hinges on the leading ends of the first to (n−2)-th slats of the successive turns are superposed on radial lines interconnecting the center of the polygonal form and the first to (n−1) apices of the polygonal form, while the hinges between the (n−1)-th slat and the n-th slates of the successive turns are superposed along a line which extends in parallel with a radial line passing through the center of the polygonal form and the n-th apex of the same.

18 Claims, 12 Drawing Sheets

ARCHITECTURAL SHUTTER CURTAIN DEVICE

BACKGROUND OF THE INVENTION

Field of the Invention

The present invention relates to an architectural shutter curtain device composed of a plurality of slats connected by hinges in series so as to be wound in a polygonal form.

Description of Related Art

Architectural shutter devices which can be wound in a polygonal form, e.g., hexagonal form, have been proposed in recent years.

FIG. 5 shows a typical example of such an architectural shutter curtain S in a state wound in hexagonal form.

As will be seen from this Figure, the shutter curtain S has a plurality of slats connected in series. The first to fifth slates $P_1$ to $P_5$ are arranged at a pitch which corresponds to the length of each side of the hexagon, and the sixth slat $P_6$ has a width which is greater than the pitch of the slats $P_1$ to $P_5$ but smaller than the first to fifth slats $Q_1$ to $Q_5$ of the next turn. A take-up shaft 30 on which the shutter curtain S is wound is arranged such that the points of connection between adjacent slats are disposed on radial lines which extend from the center of the hexagon and through the respective apices of the polygon, whereby the shutter curtain S wound on the take-up shaft 30 has an hexagonal cross-section.

According to this arrangement, only the sixth slat, e.g., the slat $P_6$, of each turn of hexagonal form has to have a width different from that of other slats, e.g., slats $P_1$ to $P_5$, of the same turn. The same problem occurs also in the groups of slats which form successive turns of the polygon. In addition, the sixth slats of the different groups of slats corresponding to each successive layer of the polygon have different widths. In other words, the shutter curtain device has to include a plurality of odd-width slats each of which have different widths and which have to be incorporated every predetermined number of slats in the slat train. Consequently, the number of parts of the shutter curtain S is increased. This complicates the shutter curtain assembly. In addition, the leading hinge 31*a* of the sixth slat $P_6$ overlaps the leading hinge 31 of the first slat $P_1$ of the same hexagon, with the result that the winding diameter of the shutter curtain S abruptly changes at this portion of the shutter curtain to cause a local concentration of force to this portion, resulting in damage to or deformation of the slats.

SUMMARY OF THE INVENTION

Accordingly, an object of the present invention is to provide a shutter curtain device which is improved to eliminate the above-described problems of the prior art.

According to the present invention, there is provided an architectural shutter curtain device, comprising a train of a plurality of slats connected in series and adapted to be wound to form a plurality of turns on a take-up shaft of a polygonal shape having n apices, the width of the slats being varied in accordance with the change in the diameter of the wound shutter curtain device, wherein the improvement comprises that, in a group of n pieces of slats which form any one of the turns of polygonal form formed when the shutter curtain device S is wound, the first to (n−2)-th slats and the n-th slat $P_n$ as counted from the winding start end have an equal width corresponding to the length of one side of the polygonal form, while the (n−1)-th slat of the group has the same width as the first to (n−2)-th slats of the group of n pieces of slats which form the next turn of a polygonal form of an increased size, and the take-up shaft for winding the shutter curtain device thereon is so constructed that the hinges on the leading ends of the first to (n−2)-th slats of the successive turns are superposed on radial lines interconnecting the center of the polygonal form and the first to (n−1) apices of the polygonal form, while the hinges between the (n−1)-th slat and the n-th slats of the successive turns are superposed along a line which extends in parallel with a radial line passing through the center of the polygonal form and the n-th apex of the same.

The shutter curtain device of the present invention can be wound correctly in the form of a polygon having n corners, using n pieces of slats of a width corresponding to one side of the polygon for each turn of the winding, without requiring incorporation of odd-width slats of different widths at every predetermined number of slats in the slat train. In addition, the number of the parts is reduced and the efficiency of the assembly is improved so as to reduce the production cost. In addition, concentration of force to local portions of the shutter curtain S is avoided to enable the shutter curtain to be wound uniformly in the polygonal form.

BRIEF DESCRIPTION OF THE DRAWINGS

The above and other objects, features and advantages of the present invention will become clear from the following description of the preferred embodiment when the same is read in conjunction with the accompanying drawings, wherein.

DETAILED DESCRIPTION OF THE PREFERRED EMBODIMENTS

Figure 1:
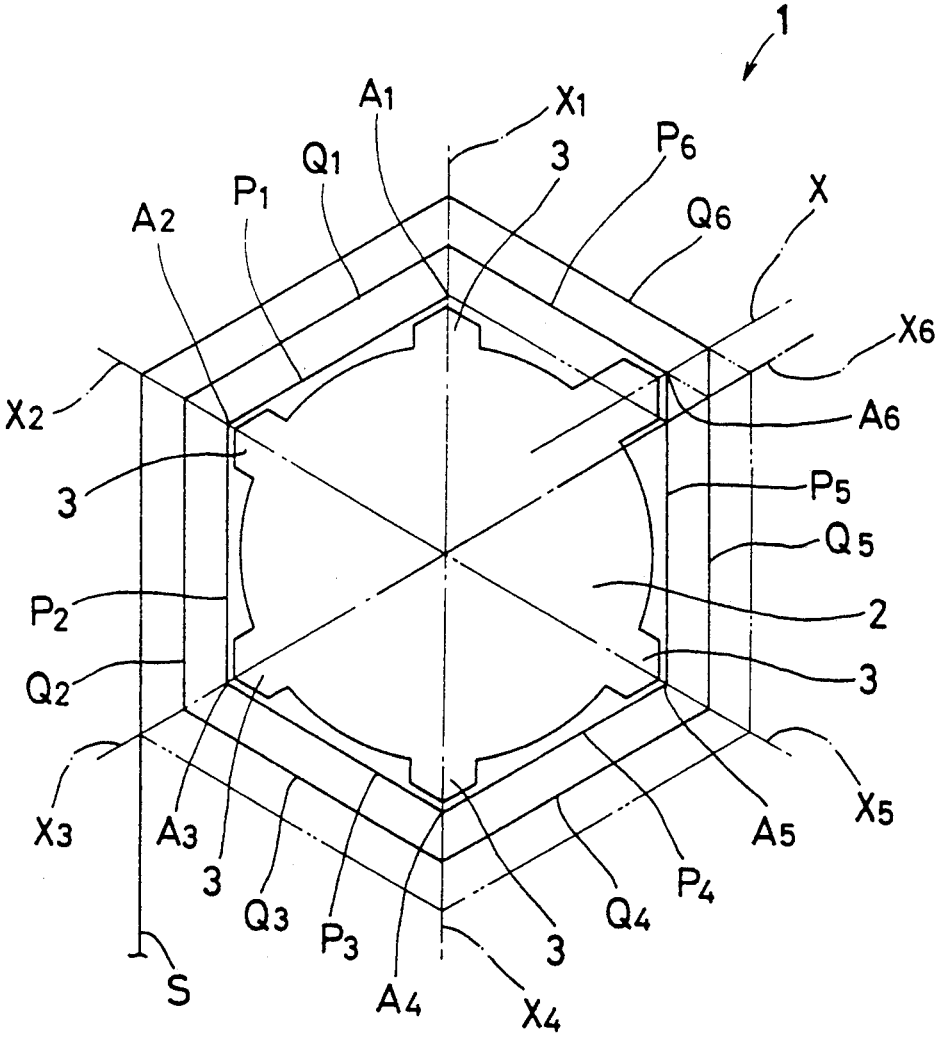
FIG. 1 is a diagrammatic side elevational view of one embodiment of the architectural shutter curtain device of the present invention in wound state.
Figure 2:
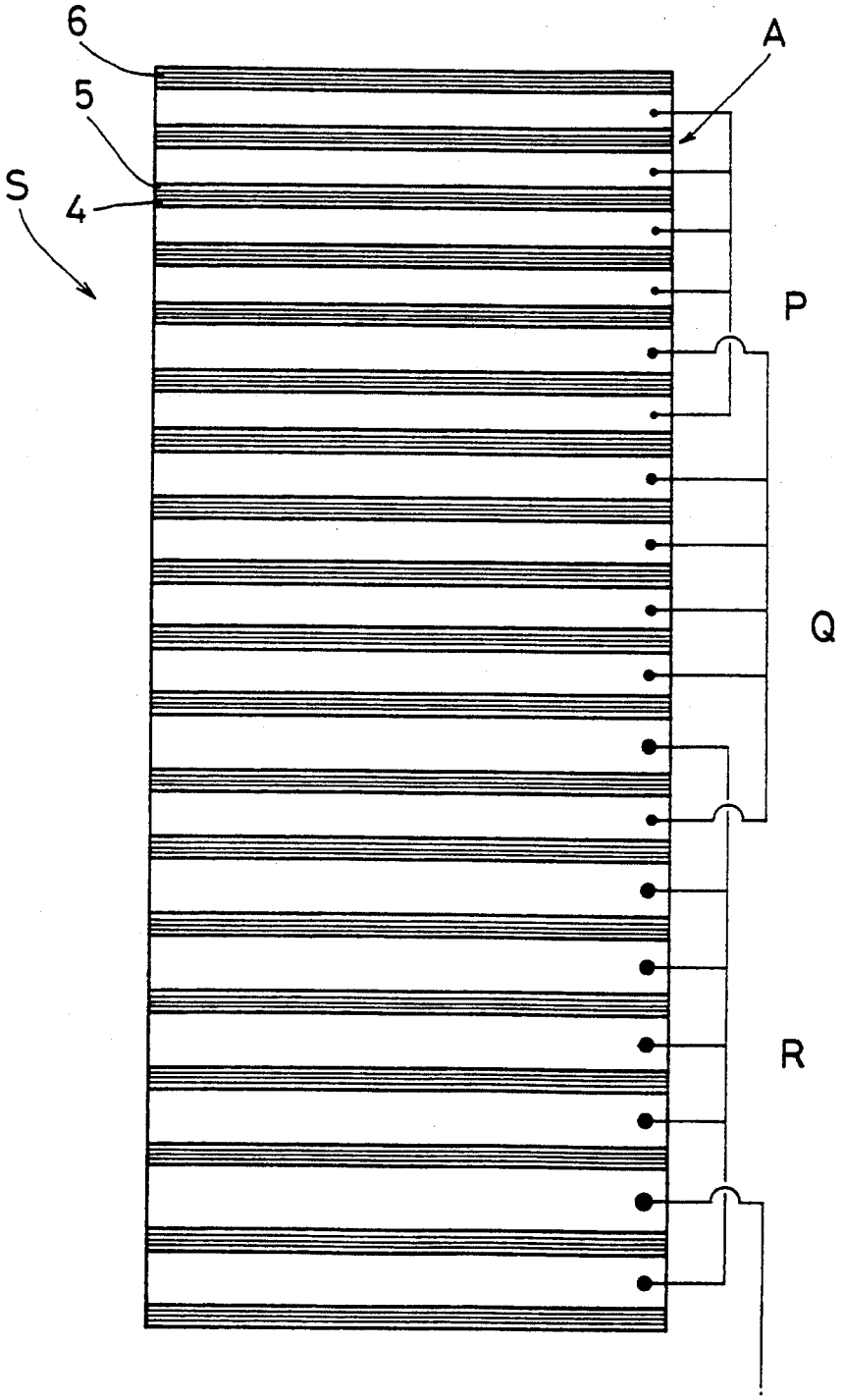
FIG. 2 is a developed view of the embodiment in FIG. 1.

FIGS. 1 and 2 are schematic illustrations of an embodiment of the architectural shutter curtain device in accordance with the present invention.

Referring to the Figures, numeral 1 generally denotes the shutter curtain S composed of a plurality of groups P, Q, etc. of slats, the pitches or widths of the slats of different groups differing so that each group forms one layer or turn when wound in a hexagonal form. For the purpose of facilitating understanding, the slats which form an underlying or first turn will be referred to as slats P, and the slats of the overlying or next turn will be referred to as slats Q.

In the illustrated embodiments, among six slats $P_1$ to $P_6$ which form the first hexagonal turn, the first to fourth slats $P_1$ to $P_4$ and the sixth slat $P_6$ as counted from the starting end of the turn have the same width corresponding to the length of one side of a hexagon, while the fifth slat $P_5$ has a width which is the same as the first to fourth slat $Q_1$ to $Q_4$ of the next hexagonal turn which is to be wound on the first turn formed by the slats $P_1$ to $P_6$.

Thus, the shutter curtain S is composed only of slats the widths of which correspond to the length of one side of a hexagon, and no odd-width slat, as presented in the prior art, is used.

A take-up shaft 2 on which the shutter curtain S is to be wound has projections 3 which are to support the hinges $A_1$ to $A_6$ of slats P, Q and so forth. More specifically, these projections 3 are arranged such that the hinges $A_1$ to $A_5$ of the first to fourth slats of the successive turns or slat groups P and Q are superposed at points which are on radial lines $X_1$ to $X_5$ interconnecting opposing apices of the hexagon, while the hinges $A_6$ between the fifth and sixth slats are located on a line X which is parallel to the radial line $X_6$ passing opposing apices of the hexagon. Thus, the projection 3 which supports the hinge $A_6$ is located at a point where the fifth slat $P_5$ intersects the next polygonal turn formed by the next group Q of the slats. Therefore in this embodiment, the hinge $A_6$ is positioned between the envelope circle of the next hexagonal turn of the slats. In this manner, the shutter curtain S is wound so as to progressively increase the diameter such that angles formed between successive slats are equal, thus enabling a uniform winding to ensure that all the hinges $A_1$ to $A_6$ are equally loaded.

When the shutter curtain S is wound on the take-up shaft 2, the hinges $A_1$ to $A_6$ of the slats P, Q and so on are supported on the projections 3 of the shaft 2 such that the hinges A of the successive turns are superposed to the hinges $A_1$ on $A_6$ of the underlying turn, thus forming successive turns of hexagons of different sizes.

More specifically, the first to fourth slats $P_1$ to $P_4$ and $Q_1$ to $Q_4$ are wound such that they form first to fourth sides of the hexagonal turns, since the hinges $A_1$ to $A_5$ of these slats are positioned on the radial lines $X_1$ to $X_5$. The fifth and sixth slats $P_5$, $P_6$ and $Q_5$, $Q_6$ are wound such that the hinges $A_6$ between the fifth and sixth slats are positioned on the line X which is parallel to the radial line $X_6$ passing through apices of the hexagon, such that these hinges $A_6$ are located intermediately between the envelope circle of the first hexagonal turn and the envelope circle of the next hexagonal turn of the slats, whereby the diameter of the circle formed by the wound shutter curtain is increased progressively.

As a consequence, an abrupt change in the winding diameter is avoided to eliminate concentration of forces at the hinges $A_6$ thereby preventing breakage of the slats.

Figure 3:
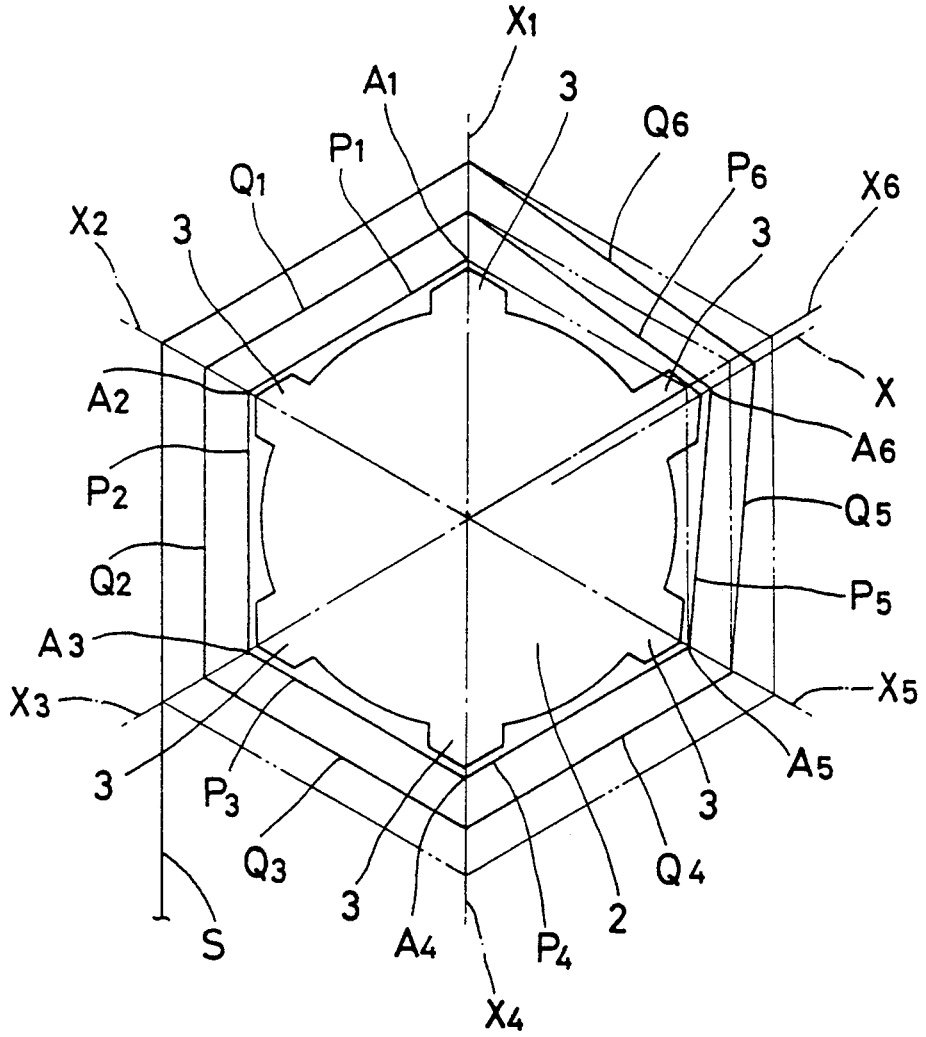
FIG. 3 is a diagrammatic side elevational view of another embodiment of the architectural shutter curtain device of the present invention in wound state.
Figure 4:
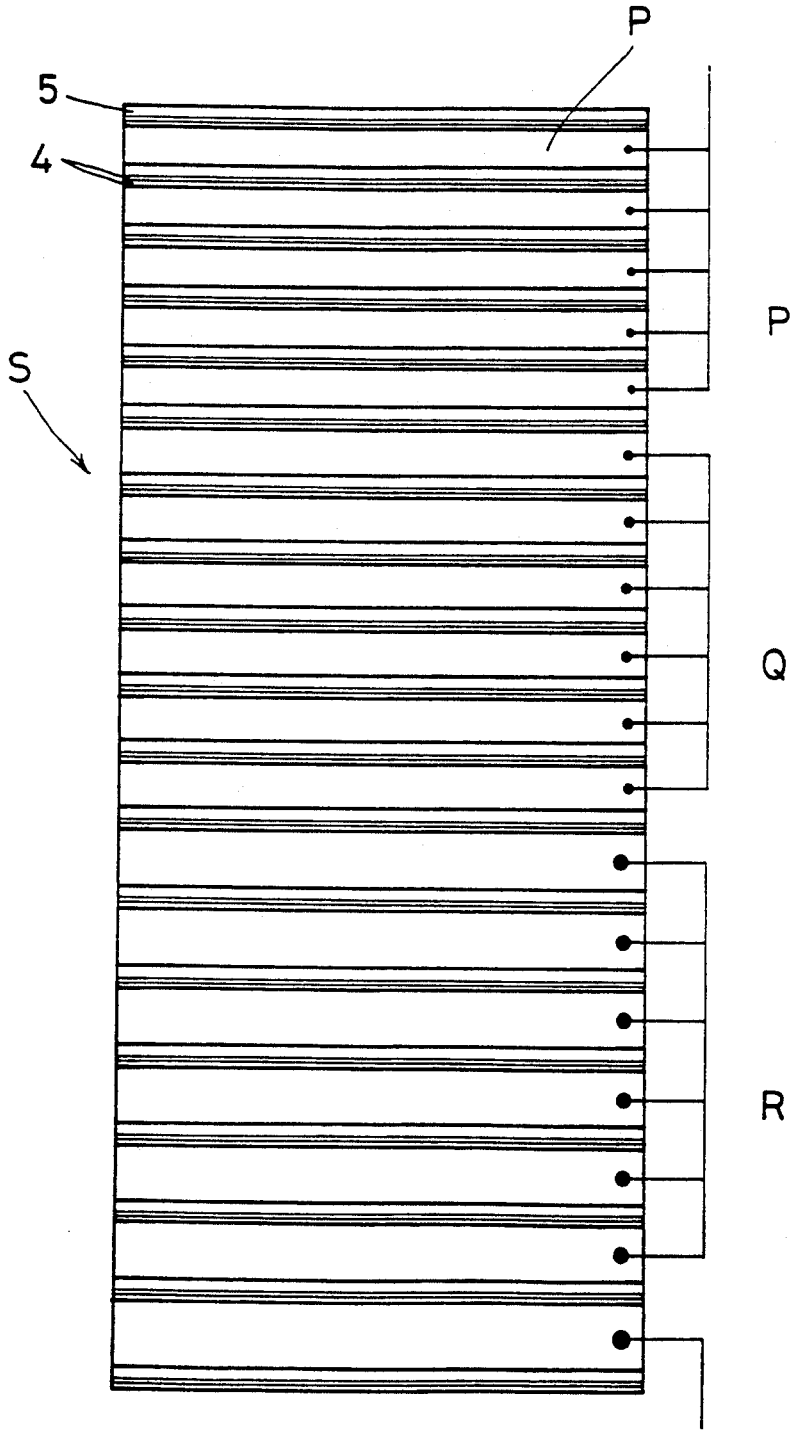
FIG. 4 is a developed view of the embodiment in FIG. 3.
Figure 5:
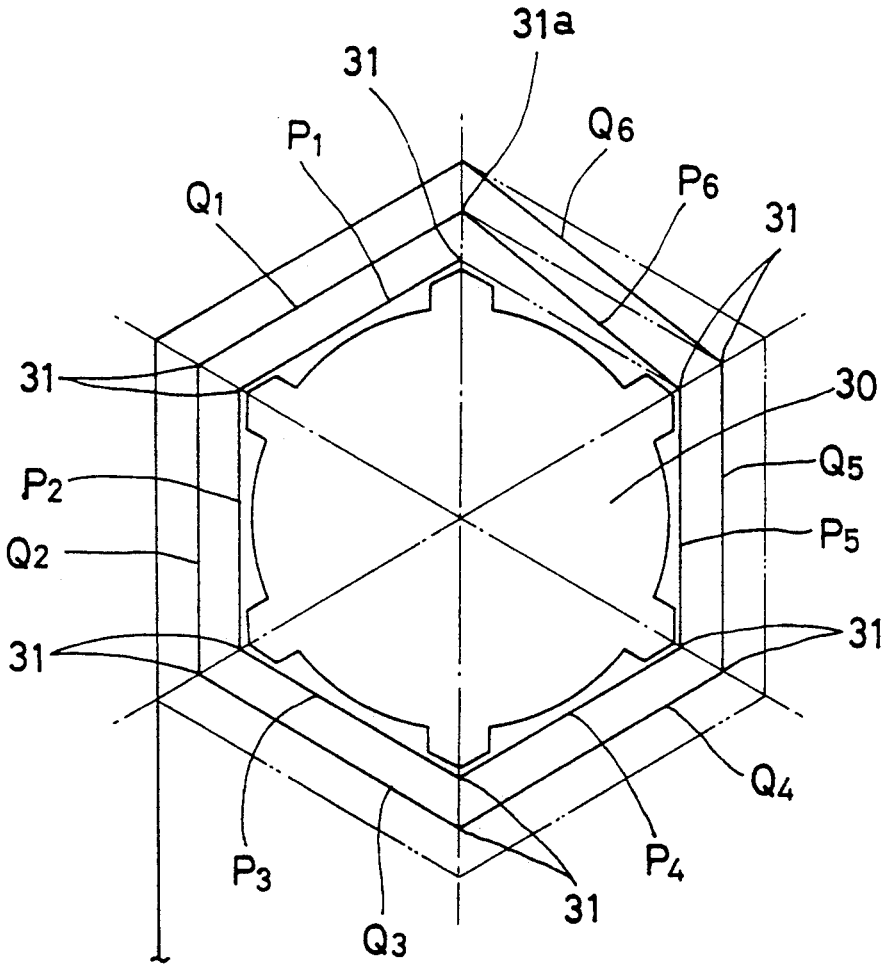
FIG. 5 PRIOR ART
FIG. 5 is a side elevational view of a known architectural shutter curtain device.
Figure 6:
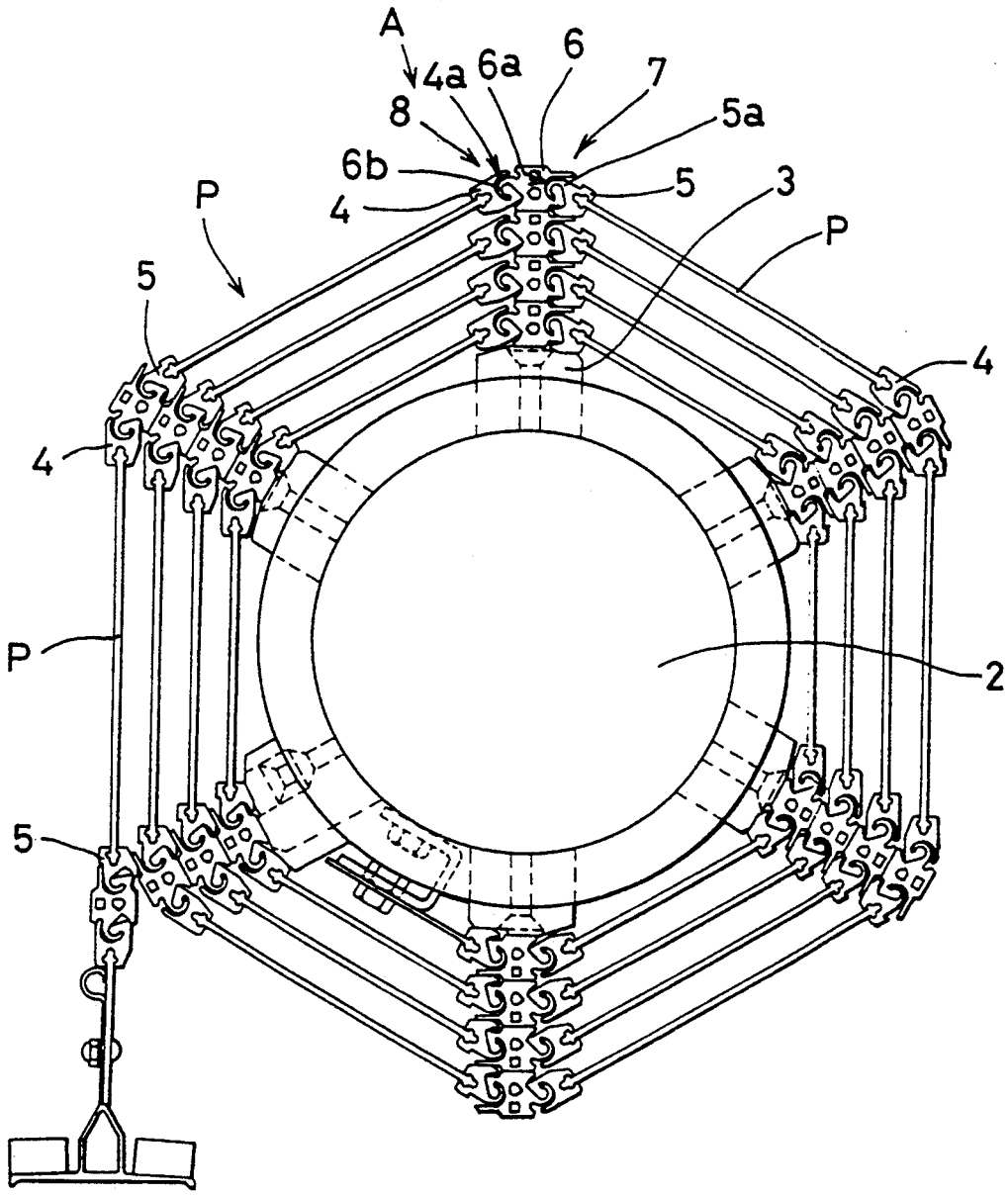
FIG. 6 is a side elevational view of an example of a hinge structure used in the architectural shutter curtain device of the present invention.
Figure 7A:
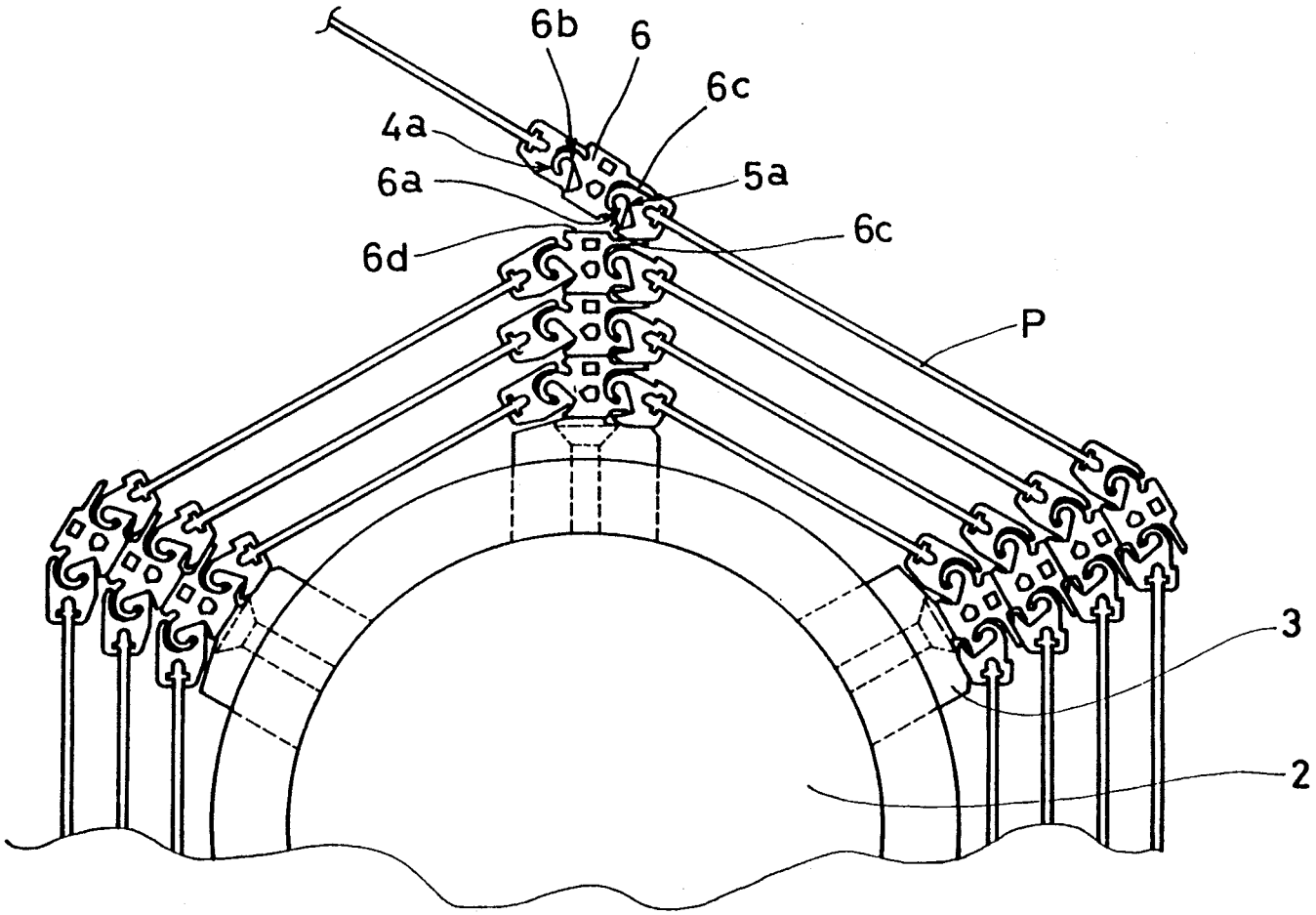
FIGS. 7(A), 7(B) and 7(C) are enlarged side elevational views illustrating methods of winding the architectural shutter curtain device of the present invention.
Figure 7B:
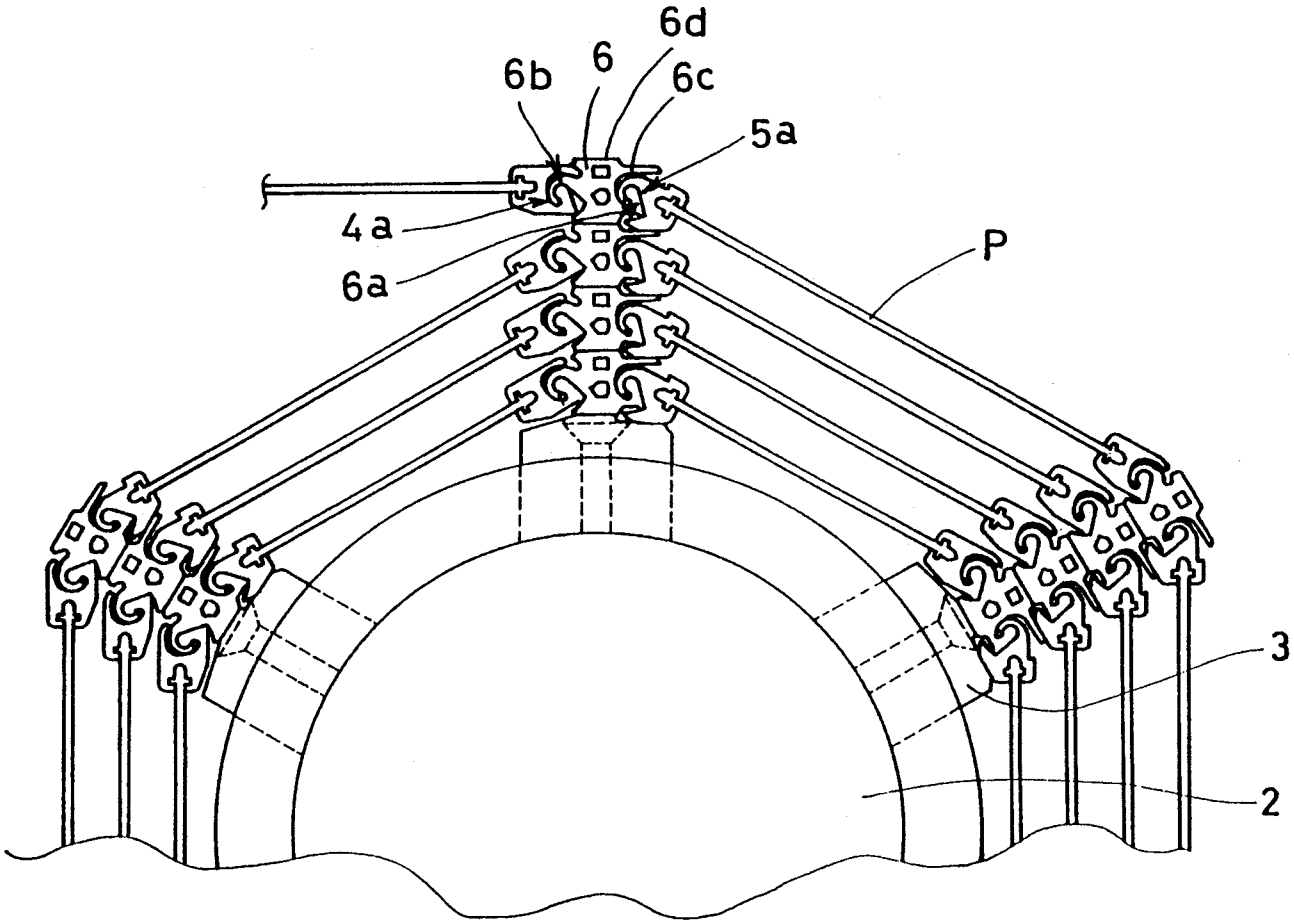
Figure 7C:
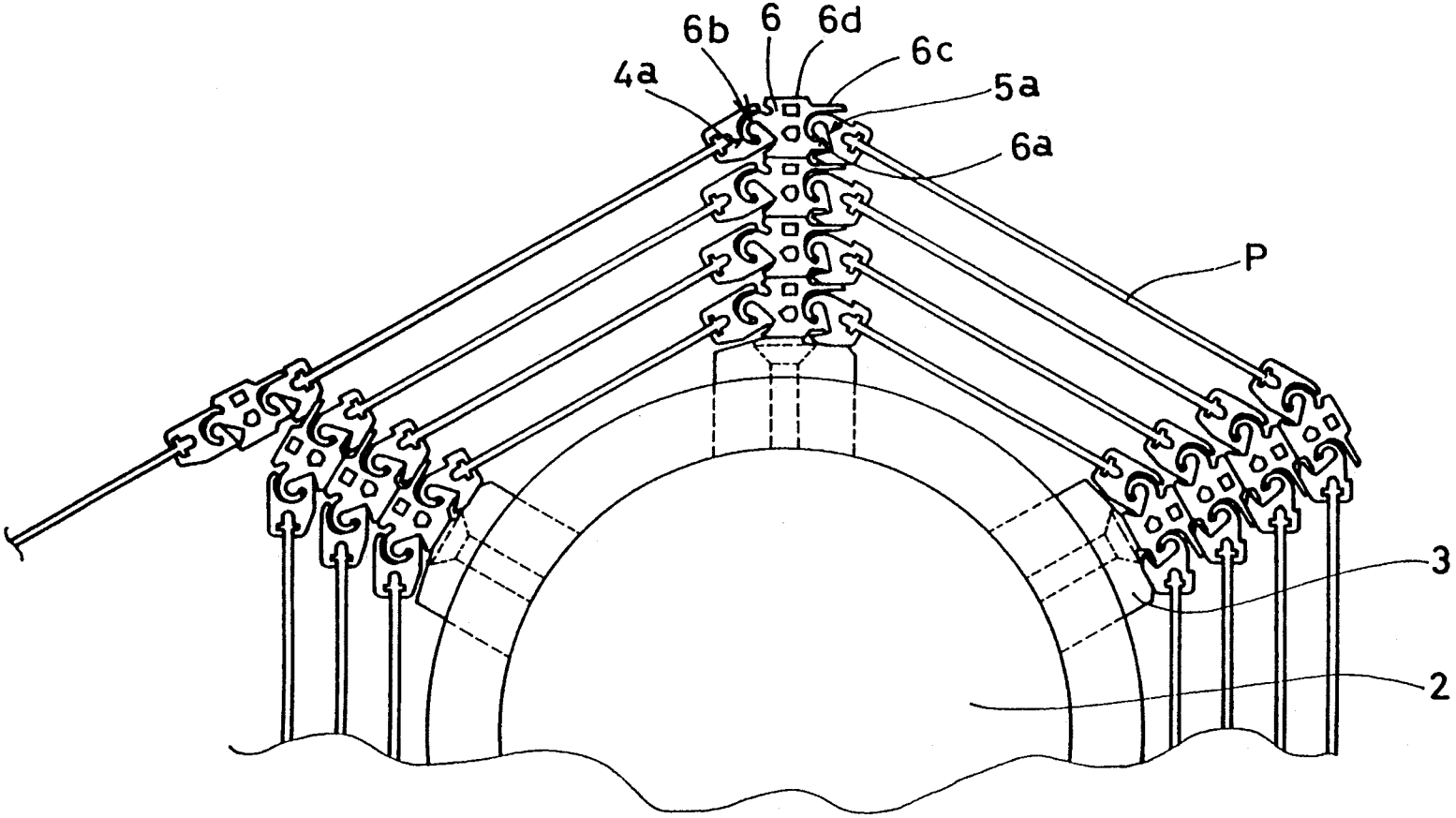

FIGS. 3 and 4 are a diagrammatic side elevational view and a developed view of another embodiment.

In this embodiment, among six slats $P_1$ to $P_6$ which form a hexagon when wound, the first to fifth slats $P_1$ to $P_5$, as counted from the staring end of the winding, have the same width which corresponds to one side of the hexagon, while the sixth slat $P_6$ has a width which is the same as that of the first to fifth slat $Q_1$ to $Q_5$ of the next group of flats Q which are to form a hexagon of the greater size.

In this embodiment, the sixth slat $P_6$ of the slats of each group has a greater width than the slats $P_1$ to $P_5$ of the same group, unlike the embodiment represented in FIG. 1 and 2 in which the fifth slat $P_5$ has a greater width than others. Therefore, in this embodiment the shutter curtain S can be formed by successively connecting groups of slats, each including six successive slats of the same width. This shutter curtain device S also can be wound in such a manner as to form hexagons of increasing diameters, without requiring the use of an odd-width slat. This embodiment does not have the advantage of the same angle being formed at all the hinges A offered by the first embodiment, but the other advantage, e.g., elimination of the necessity for the use of an odd-width slat, is also offered by this embodiment.

Although in the described embodiments successive slats P and Q of the shutter curtain S are wound in hexagonal form, this is only illustrative and the shutter curtain device of the present invention can be formed in other suitable polygonal forms such as a pentagon, octagon and so forth.

A description will now be given of the structure of the hinge which interconnects the adjacent slats in the slat train forming the shutter curtain device of the present invention.

The structure of the hinge interconnecting the adjacent slats will be described with reference to FIGS. 6, 7(A), 7(B) and 7(C). Although the following description will be focused mainly on the slats P, it is to be understood that the description concerning slats P also applies to the slats Q.

The hinge A includes upper and lower interlock connecting portions 4*a* and 5*a* formed on upper and lower horizontal boxes provided on the upper and lower ends of each slat P. The interlock connecting portions 4*a* and 5*a* on each end of one slat P are connected to corresponding interlock connecting portions 4*a* and 5*a* of the adjacent ends of the next slat P through an intermediate piece 6. The intermediate piece 6 is provided at its upper and lower ends thereof with interlock hinge portions 6*a* and 6*b* which are pivotally connected to the upper and lower interlock connecting portions 4*a* and 5*a* of the adjacent slats. More specifically, the lower interlock connecting portion 5*a* of a slat P is connected to the upper interlock hinge portion 6*a* (upper hinge 7), while the lower interlock hinge portion 6*b* is connected to the upper interlock connecting portion 4*a* (lower hinge 8). In this manner, the successive slats are connected to form the shutter curtain S.

The upper interlock hinge portion 6*a* of the intermediate piece 6 is provided with a first support portion 6*c*. When the shutter curtain S is wound, the successive slats are folded relative to each other at the lower hinge 8 composed of the upper interlock connecting portion 4a and the lower interlock hinge portion 6b, when the successive turns of a polygon are placed one on the other. The arrangement is such that, at the point of folding, the lower horizontal box 5 of the slat P is received and borne by the first support portion 6c which is in surface contact therewith, as will be seen from FIG. 7(A). The intermediate piece 6 also is provided with a tubular second support portion 6d. The second support portion 6d is so constructed as to make surface contact with the intermediate piece 6 which is flexed about the upper hinge 7 which is borne by the first supporting portion 6c, as will be seen from FIG. 7(B). In addition, the upper horizontal box 4 of the slat P which is folded next about the second support portion 6d is spaced apart from the intermediate piece 6 and the upper horizontal box 4 of the underlying layer, as will be seen from FIG. 7(C). With this arrangement, it is possible to wind the shutter curtain S continuously such that the intermediate pieces 6 are located on the apices of the polygons. In addition, the lower horizontal boxes 5 of the underlying turn and the overlying turn on the corresponding apices of polygons are aligned with each other in a circumferential direction. Similarly, the intermediate pieces 6 of the successive turns are aligned with each other. Therefore, damage to the lower horizontal boxes 5 and intermediate pieces 6 due to rubbing is avoided. In addition, the upper horizontal boxes 4 of the adjacent turns are kept from contacting each other. Consequently, the load which is generated when the successive slats P are flexed during winding is distributed to and borne by two surface contacts, thus preventing any rubbing of the upper horizontal boxes 4 with each other. It is therefore possible to prevent degradation of appearance of the shutter curtain for a long time.

Figure 8:
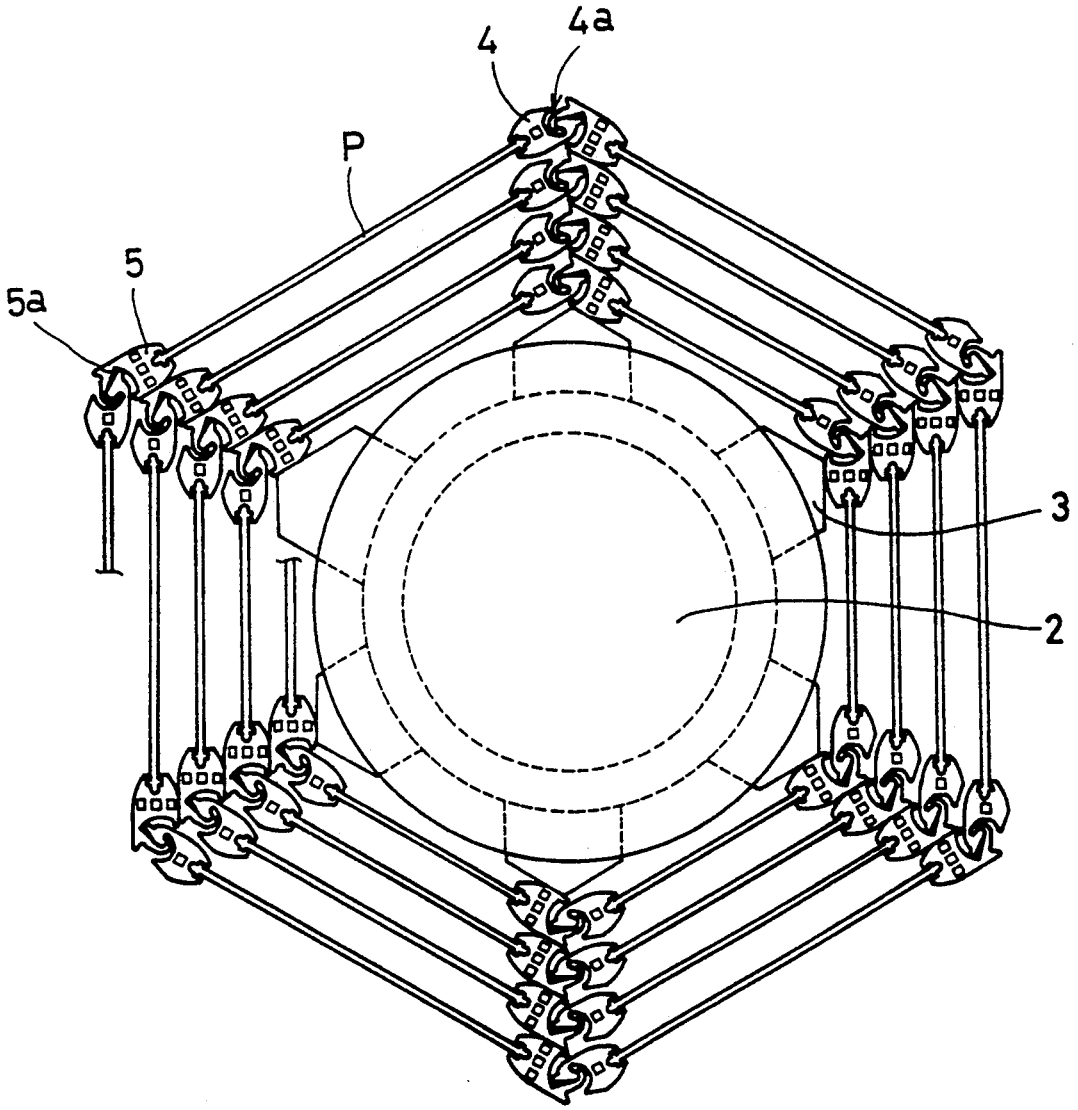
FIG. 8 is a side elevational view of another example of the hinge structure used in the architectural shutter curtain device of the present invention.

FIG. 8 shows another example of the hinge structure between adjacent slats. This hinge structure does not include an intermediate piece 6. Namely, successive slats P are connected directly at the upper and lower interlock connecting portions 4a and 5a which are formed on the upper and lower horizontal boxes 4 and 5 provided on the upper and lower ends of these slats P. It will be understood by those skilled in the art that this type of hinge also enables winding of the shutter curtain S in a polygonal form as previously explained.

Figure 12:
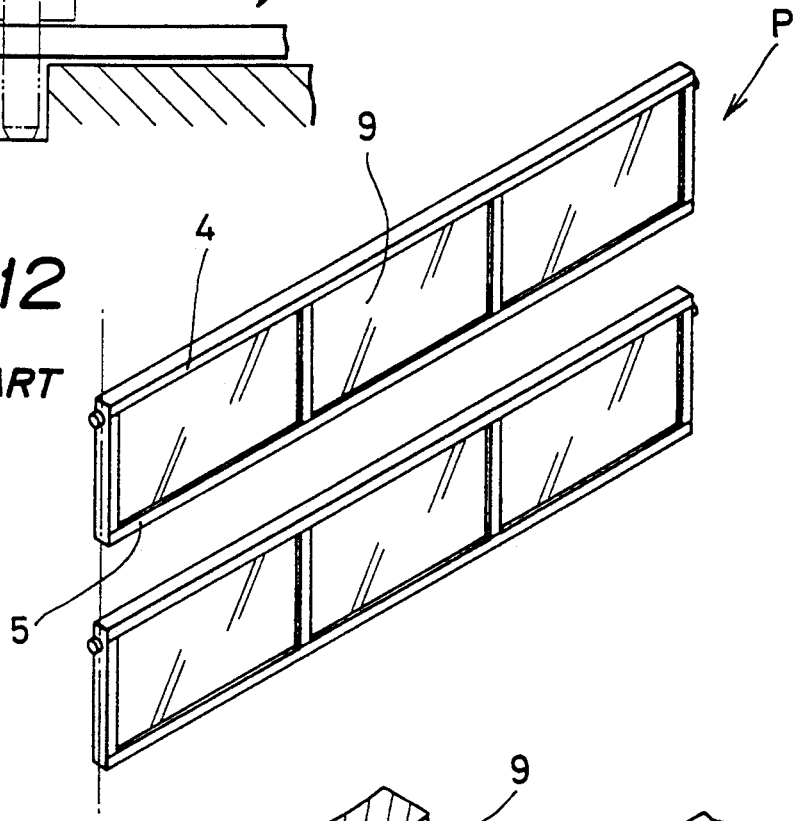
FIG. 12 PRIOR ART
FIG. 12 is a perspective view of a known architectural shutter curtain device.
Figure 13:
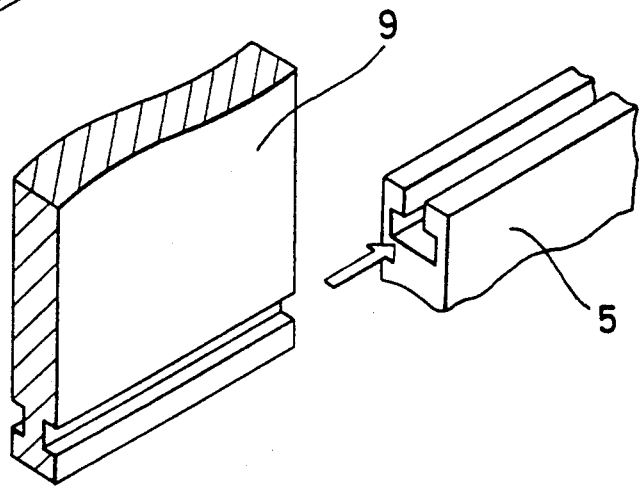
FIG. 13 PRIOR ART
FIG. 13 is a perspective view of a different known architectural shutter curtain device.

A description will now be given of the construction of each slat P as represented in FIGS. 9 through 13. The slat P may be of a type which has a flat plate portion 9 and upper and lower horizontal boxes 4 and 5 which are molded integrally with the flat plate portion 9, as shown in FIGS. 12 and 13. This type of slat is advantageously used in a follow-type shutter curtain device. However, this type of slat requires that a variety of sizes of molds are required to provide slats with different vertical heights or widths according to the winding diameter. To eliminate this problem, according to the invention, it is proposed to form the upper and lower boxes 4 and 5 separately from the flat plate portion 9. Namely, the upper and lower horizontal boxes 4 and 5 are secured to the upper and lower ends of the respective flat plate portions 9 of the desired vertical heights or widths cut out from a blank sheet. The connection between the flat plate portion 9 and the upper and lower horizontal boxes is preferably accomplished by structures which will be described with reference to FIGS. 9 and 10.

Figure 9:
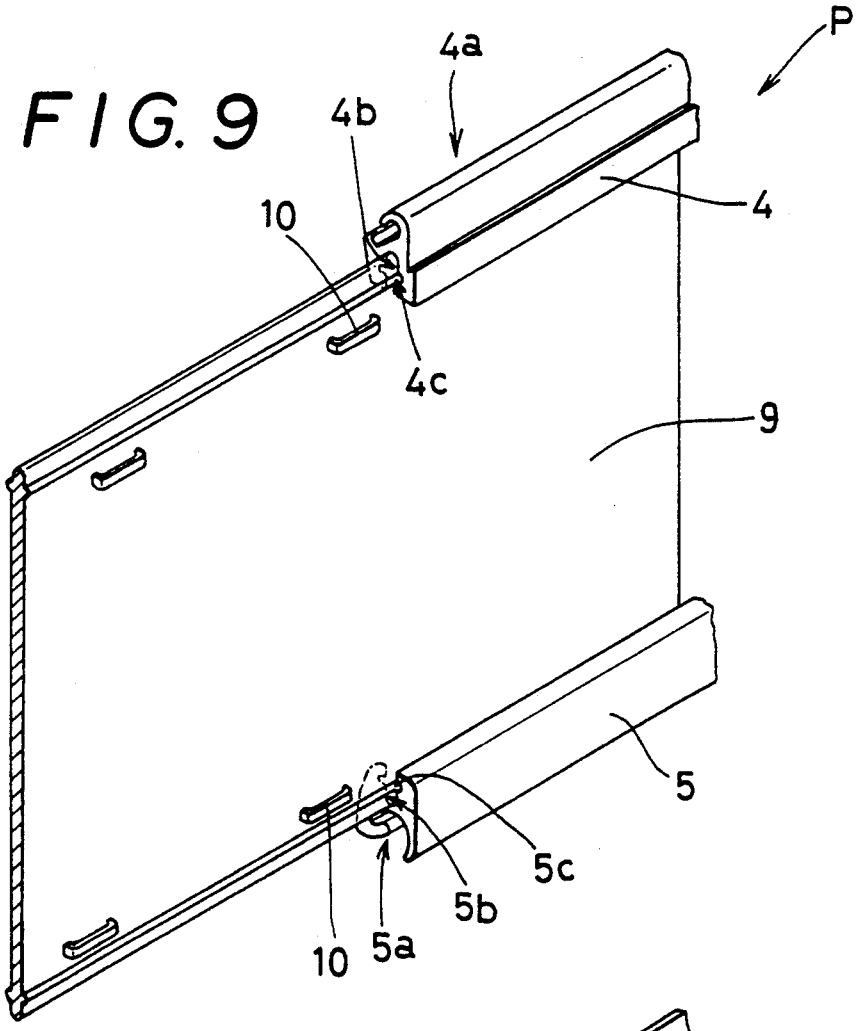
FIG. 9 is a perspective view of a critical portion of an example of a slat used in the architectural shutter curtain device of the present invention.

In a connection structure shown in FIG. 9, a flat plate portion 9, made of a transparent synthetic resin, is provided with a plurality of metallic staples 10 studded along the upper and lower edges thereof. On the other hand, the horizontal boxes 4 and 5 are provided with slat-receiving grooves 4b and 5b for receiving the upper and lower ends of the flat plate portion 9. The grooves 4b and 5b are provided with engaging notches 4c and 5c for the engagement with the staples 10 on the flat plate portion 9. The upper and lower horizontal boxes 4 and 5 can easily be secured to the flat plate portion 9 by being made to slide along the upper and lower edges of the flat plate portion 9 from one end to the other of the flat plate portion 9, such that the staples 10 engage with the engaging notches 4c and 5c. This connecting structure can securely hold the upper and lower horizontal boxes 4 and 5 on the flat plate portion 9 against wind or other external forces. In addition, the staples 10 can be studded to the flat plate portion 9 without difficulty.

Figure 10:
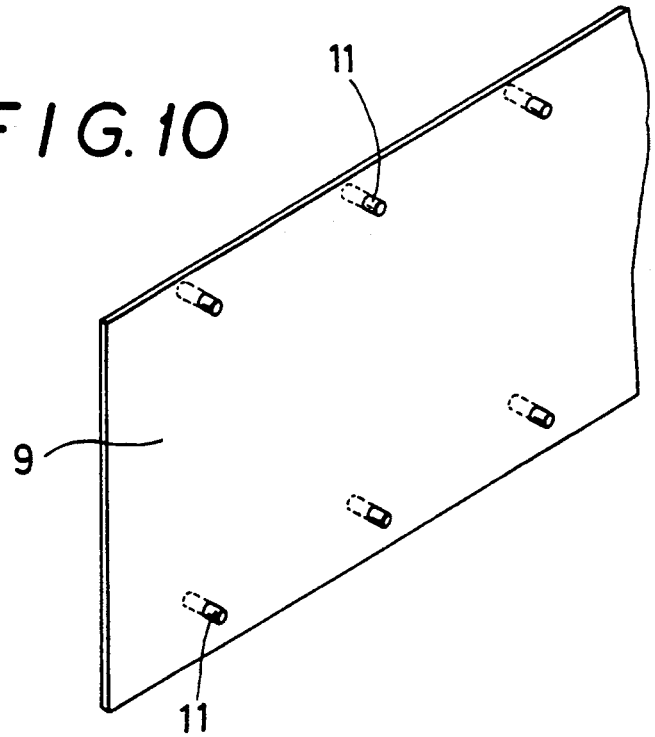
FIG. 10 is a perspective view of a critical portion of another example of a slat used in the architectural shutter curtain device of the present invention.
Figure 11:
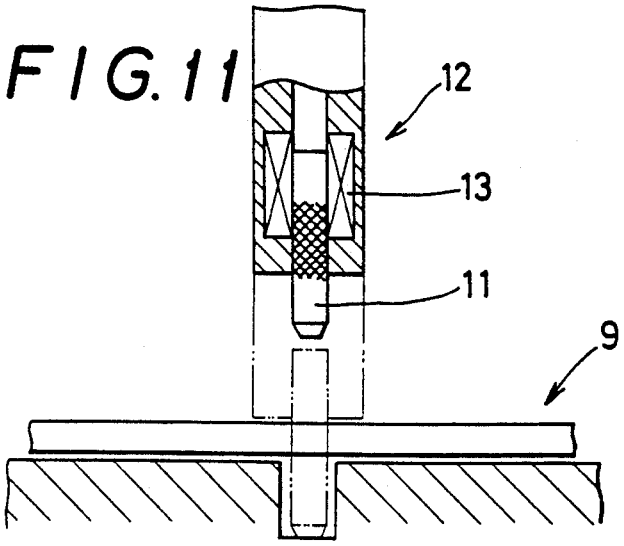
FIG. 11 is a front elevational view of an example of a means for studding an anchoring member on a slat.

FIG. 10 shows another example of the connecting structure. In this case, pins 11, made of a synthetic resin or a metal, are studded, in place of the staples 10 of the previous example, the surfaces of a flat plate portion 9 which is made of a sheet of a synthetic resin or glass. The pin 11 may be of the type composed of a female screw and a male screw which are driven into each other across the flat plate portion 9 or a spring pin which is press-fitted through a hole formed in the flat plate portion 9.

When the flat plate portion 9 is made of a thermoplastic resin, it is possible to use a pin driver 12 which drives heated pins 11 into the flat plate portion 9 which has been heated to a temperature above the softening point by, for example, a heater 13 incorporated in the pin driver 12. The pins 11 driven through the flat plate portion 9 are integrally fixed to the flat plate portion 9 as the resin is cooled and hardened. This method eliminates a necessity for forming perforations along the upper and lower edges of the flat plate portion 9, as well as troublesome work for fixing each of a multiplicity of pins 11. In addition, cracking of the flat plate portion at its edges is avoided because the flat plate portion 9 is softened when the pins 11 are driven through the flat plate portion.

What is claimed is:

1. An architectural shutter curtain device comprising:

a train of a plurality of slats connected in series; and a polygonal take-up shaft having n apices, the train of a plurality of slats being adapted to be wound to form a plurality of turns on the take-up shaft, a group of n pieces of slats forming any one of said turns, and varied in width to correspond to different diameters of the wound shutter curtain device S having a polygonal form wherein:

a first to (n−2)-th slats, $P_1$ to $P_{(n-2)}$, as counted from a starting end of the group of wound slats, $P_1$ to $P_n$, have an equal width corresponding to the length of one side of said polygonal form; and an (n−1)-th slat, $P_{n-1}$, of said group, as counted from the starting end of the group of wound slats, $P_1$ to $P_n$, has the same width as a first to (n−2)-th slats, $Q_1$ and $Q_{n-2}$, of a group of wound slats, $Q_1$ to $Q_n$, forming the next turn and overlaying the group of wound slats, $P_1$ to $P_n$, to form a polygonal form of increased size.

2. The architectural shutter curtain device according to claim 1 further comprising:

a plurality of hinges between an m-th slat, wherein m is an integer from 1 to n, and an adjacent (m+1)-th slat of each turn said plurality of hinges successively superposed on the apices of said polygonal form.

3. The architectural shutter curtain device according to claim 2 wherein:

line $A_1$ denotes the line extending from the hinge between the first slat $P_1$ of a first turn and the take-up shaft to the hinge between the first slat $Q_1$ of each succeeding group of slats and the n-th slat $P_n$ of the preceding group, and line $A_{n-1}$ represents the line extending from the hinge between the (n−2)-th slat and the (n−1)-th slat of each group, the lines $A_1$ to $A_{n-1}$ being superposed along radial lines, $X_1$ to $X_{n-1}$, which interconnect the center of the polygonal form and the first to (n−1)-th apices of said polygonal form.

4. The architectural shutter curtain device according to claim 3 wherein:

the line $A_n$ denotes the line extending from the hinges between the adjacent (n−1)-th slat and the n-th slat of the successive groups of slats and is superposed along a line X extending in parallel with one of the plurality of radial lines interconnecting said center of said polygonal form and the n-th apex of said polygonal form, whereby said shutter curtain device is wound such that the n-th apex of each turn is offset from the n-th apex of the polygon of said take-up shaft.

5. The architectural shutter curtain device according to claim 2, wherein said hinge further comprises:

a upper and a lower interlock connecting portions formed on a upper and a lower horizontal boxes provided on a upper and a lower ends of each slat; and an intermediate piece having upper and lower interlock hinge portions swingably connected to the lower and upper interlock connecting portions of the two adjacent slats.

6. The architectural shutter curtain device according to claim 5, wherein said intermediate piece further comprises:

a first support portion which receives and supports, in a surface contact condition, the lower horizontal box of a slat of the next turn, flexed at said upper interlock connecting portion; and a second support portion which receives and supports the intermediate piece being annexed to said slat and swung about the lower interlock connecting portion held by said first support portion.

7. The architectural shutter curtain device according to claim 6, wherein the upper horizontal box swung about said second support portion and provided with said upper interlock connecting portion is configured so as to be spaced from said intermediate piece and said upper horizontal box of the underlying turn.

8. The architectural shutter curtain device according to claim 1, wherein each slat comprises:

a flat plate portion containing a plurality of anchoring members; and upper and lower horizontal boxes which are provided with connecting portions for connection to adjacent slats, wherein the upper and lower horizontal boxes are arranged substantially on a straight line along each of the upper and lower ends of said flat plate portion and projecting from the surfaces of said flat plate portion.

9. The architectural shutter curtain device according to claim 8, wherein said upper and lower horizontal boxes further comprise:

a slat-receiving groove for receiving the adjacent end of the flat plate portion of said slat; and a plurality of slat engaging notches continuous from said slat receiving groove, capable of receiving and anchoring the plurality of anchoring members when said horizontal box is made to slide along the adjacent end of the flat plate portion, whereby the plurality of slat engaging notches retaining said plurality of anchoring members prevent separation of the upper and lower horizontal boxes from said flat plate portion.

10. An architectural shutter curtain device comprising:

a train of a plurality of slats connected in series; and a polygonal take-up shaft having n apices, the train of a plurality of slats being adapted to be wound to form a plurality of turns on the take-up shaft, a group of n pieces of slats forming any one of said turns, and varied in width to correspond to different diameters of the wound shutter curtain device S having a polygonal form wherein:

a first to (n−1)-th slats, $P_1$ to $P_{(n-1)}$, as counted from a starting end of the group of wound slats, $P_1$ to $P_n$, have an equal width corresponding to the length of one side of said polygonal form; and an n-th slat, $P_n$, of said group, as counted from the starting end of the group of wound slats, $P_1$ to $P_n$, has the same width as a first to (n−1)-th slats, $Q_1$ to $Q_{n-1}$, of a group of wound slats, $Q_1$ to $Q_n$, forming the next turn and overlaying the group of wound slats, $P_1$ to $P_n$, to form a polygonal form of increased size.

11. The architectural shutter curtain device according to claim 10 further comprising:

a plurality of hinges between an m-th slat, wherein m is an integer from 1 to n, and an adjacent (m+1)-th slat of each turn said plurality of hinges successively superposed on the apices of said polygonal form.

12. The architectural shutter curtain device according to claim 11 wherein:

line $A_1$ denotes the line extending from the hinge between the first slat $P_1$ of a first turn and the take-up shaft to the hinge between the first slat $Q_1$ of each succeeding group of slats and the n-th slat $P_n$ of the preceding group, and line $A_{n-1}$ represents the line extending from the hinge between the (n−2)-th slat and the (n−1)-th slat of each group, the lines $A_1$ to $A_{n-1}$ being superposed along radial lines, $X_1$ to $X_{n-1}$, which interconnect the center of the polygonal form and the first to (n−1)-th apices of said polygonal form.

13. The architectural shutter curtain device according to claim 12 wherein:

the line $A_n$ denotes the line extending from the hinges between the adjacent (n−1)-th slat and the n-th slat of the successive groups of slats and is superposed along a line X extending in parallel with one of the plurality of radial lines interconnecting said center of said polygonal form and the n-th apex of said polygonal form, whereby said shutter curtain device is wound such that the n-th apex of each turn is offset from the n-th apex of the polygon of said take-up shaft.

14. The architectural shutter curtain device according to claim 11, wherein said hinge further comprises:

upper and lower interlock connecting portions formed on upper and lower horizontal boxes provided on upper and lower ends of each slat; and an intermediate piece having upper and lower interlock hinge portions swingably connected to the lower and upper interlock connecting portions of the two adjacent slats.

15. The architectural shutter curtain device according to claim 14, wherein said intermediate piece further comprises:

a first support portion which receives and supports, in a surface contact condition, the lower horizontal box of a slat of the next turn, flexed at said upper interlock connecting portion; and a second support portion which receives and supports the intermediate piece being annexed to said slat and swung about the lower interlock connecting portion held by said first support portion.

16. The architectural shutter curtain device according to claim 15, wherein the upper horizontal box swung about said second support portion and provided with said upper interlock connecting portion is configured so as to be spaced from said intermediate piece and said upper horizontal box of the underlying turn.

17. The architectural shutter curtain device according to claim 10, wherein each slat comprises:

a flat plate portion containing a plurality of anchoring members; and upper and lower horizontal boxes which are provided with connecting portions for connection to adjacent slats, wherein the upper and lower horizontal boxes are arranged substantially on a straight line along each of the upper and lower ends of said flat plate portion and projecting from the surfaces of said flat plate portion.

18. The architectural shutter curtain device according to claim 17, wherein said upper and lower horizontal boxes further comprise:

a slat-receiving groove for receiving an adjacent end of the flat plate portion of said slat; and a plurality of slat engaging notches continuous from said slat receiving groove, capable of receiving and anchoring the plurality of anchoring members when said horizontal box is made to slide along the adjacent end of the flat plate portion, whereby the plurality of slat engaging notches retaining said plurality of anchoring members prevent separation of the upper and lower horizontal boxes from said flat plate portion.

* * * * *